US008727831B2

(12) United States Patent
Nelson et al.

(10) Patent No.: US 8,727,831 B2
(45) Date of Patent: May 20, 2014

(54) METHOD AND SYSTEM FOR MACHINING A PROFILE PATTERN IN CERAMIC COATING

(75) Inventors: Warren Arthur Nelson, Clifton Park, NY (US); Donald Joseph Baldwin, Galway, NY (US); Lyle B. Spiegel, Niskayuna, NY (US); James Edward Viggiani, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 801 days.

(21) Appl. No.: 12/140,581

(22) Filed: Jun. 17, 2008

(65) Prior Publication Data

US 2009/0311416 A1 Dec. 17, 2009

(51) Int. Cl.
*B24C 1/04* (2006.01)

(52) U.S. Cl.
USPC ..... 451/2; 451/5; 451/29; 451/38; 451/75; 451/82

(58) Field of Classification Search
USPC ..... 451/2, 5, 29, 38, 39, 40, 75, 80, 82, 451/102, 379, 385, 398
See application file for complete search history.

(56) References Cited

U.S. PATENT DOCUMENTS 2,092,083 A * 9/1937 Ogle et al. ..... 451/82
2,272,686 A * 2/1942 McGibbon ..... 451/82
2,332,095 A * 10/1943 McGibbon ..... 451/82
5,472,330 A * 12/1995 Oka et al. ..... 425/142
5,704,824 A * 1/1998 Hashish et al. ..... 451/36
5,709,587 A * 1/1998 Shaffer ..... 451/38
5,804,009 A * 9/1998 Dings et al. ..... 156/154
5,980,988 A * 11/1999 Ljungberg ..... 427/255.19
6,004,620 A * 12/1999 Camm ..... 427/142
6,251,526 B1 6/2001 Staub
6,422,920 B1 * 7/2002 Bouten et al. ..... 451/29
6,431,954 B1 * 8/2002 Junker ..... 451/11
6,520,838 B1 * 2/2003 Shaw ..... 451/38
6,887,528 B2 5/2005 Lau et al.
6,905,396 B1 * 6/2005 Miller et al. ..... 451/38
7,066,799 B2 * 6/2006 Oussaada et al. ..... 451/439
7,544,112 B1 6/2009 Miller et al.
7,600,968 B2 10/2009 Nelson et al.
7,614,847 B2 11/2009 Nelson et al.
2004/0115447 A1 * 6/2004 Farmer et al. ..... 428/469
2005/0003172 A1 1/2005 Wheeler et al.
2010/0003894 A1 1/2010 Miller et al.

* cited by examiner

*Primary Examiner* — Eileen P. Morgan
(74) *Attorney, Agent, or Firm* — Cantor Colburn LLP

(57) ABSTRACT

A method of machining a profile pattern in a ceramic coating of a turbine shroud is provided and includes applying the ceramic coating substantially uniformly onto the turbine shroud, positioning a machining tool proximate the ceramic coating, and removing material from the ceramic coating by activating the machining tool to machine the ceramic coating and by moving the machining tool across the ceramic coating in a movement pattern that generally corresponds to the profile pattern.

18 Claims, 4 Drawing Sheets

METHOD AND SYSTEM FOR MACHINING A PROFILE PATTERN IN CERAMIC COATING

BACKGROUND OF THE INVENTION

Aspects of the present invention are directed to non-thermal methods of machining a profile pattern and, more particularly, to methods of machining a profile pattern in a ceramic coating without an exertion of lateral force or causing thermally induced stresses.

One such application of a ceramic coating which can benefit from a profile pattern is a turbine shroud. The turbine shroud is used in gas turbines to form the circumferential perimeter of the gas path above the turbine buckets. Turbine shrouds are often formed with a ceramic coating, which is frequently referred to as a thermal barrier coating (TBC), such as plasma sprayed Yttria stabilized zirconia, YSZ and a MCrAlY bond coat on a superalloy substrate, where M can be Nickel, Cobalt, or Iron.

Tight clearances between the bucket tip and the shroud flowpath are desired to minimize gas leakage over the tip and hence improve turbine performance. It is often difficult, however, to run the turbine with tight clearances because a circularity of the casing is not maintained throughout all phases of the turbine cycle and, especially, during thermal transients. For example, centrifugal loads as well as differences in thermal responses between the turbine bucket and the turbine shroud around the circumference of the turbine may lead to non-rounded expansion of the turbine casing. Here, while the ceramic coating provides for thermal insulation of the underlying metallic substrate, the ceramic coating is harder than the bucket tip and can damage the tip during a rubbing occurrence.

One solution to reducing clearances and allowing turbine bucket-shroud rubbing is to have an abradable coating as the innermost surface of the turbine shroud. In this case, the ceramic coating is sprayed thereon in patterns, such as curvilinear patterns, w-shaped patterns, or "waffle" like patterns. The patterns in the ceramic coatings are employed to aid in the abradability of the ceramic coatings. This prevents damage to the turbine buckets that would otherwise occur as a result of the turbine buckets rotating within the turbine shrouds and cutting broad swaths of material away from the ceramic coatings. Another important feature of the patterns is to direct airflow in the turbine during operations thereof. This improved directionality of the airflow above the blade tip improves turbine performance.

Currently, the patterns are formed by utilizing shielding masks during applications of successive coating layers. In some applications, the ceramic coating of increased porosity is applied onto the surface of a conventional TBC while in other applications a more porous coating is applied directly onto the MCrAlY bond coat. A particular pattern can be used in either of these cases to improve abradability and aerodynamic performance in the turbine.

BRIEF DESCRIPTION OF THE INVENTION

A method of machining a profile pattern in a ceramic coating of an article is provided and includes applying the ceramic coating substantially uniformly onto the article, positioning a machining tool proximate the ceramic coating, and removing material from the ceramic coating by activating the machining tool to machine the ceramic coating and by moving the machining tool across the ceramic coating in a movement pattern that generally corresponds to the profile pattern.

A method of forming a ceramic coating for a turbine shroud is provided and includes applying the ceramic coating substantially uniformly onto a surface of the turbine shroud configured to face a rotating turbine bucket, determining characteristics of a cutting pattern that corresponds to a selected profile pattern in the ceramic coating, positioning a machining tool proximate the ceramic coating, and selectively removing material from the ceramic coating by activating the machining tool to machine the ceramic coating and by moving the machining tool across the ceramic coating along a movement pattern that corresponds to the determined characteristics of the cutting pattern.

A system configured to form a profile pattern in a ceramic coating of a surface of a turbine shroud is provided and includes a nozzle configured to apply the ceramic coating substantially uniformly onto the surface of the turbine shroud, a machining tool positioned proximate the ceramic coating and configured to machine the profile pattern in the ceramic coating, and a machining tool supporting apparatus configured to movably support the machining tool along a movement pattern which maintains the machining tool in position proximate the ceramic coating and which corresponds to the profile pattern.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
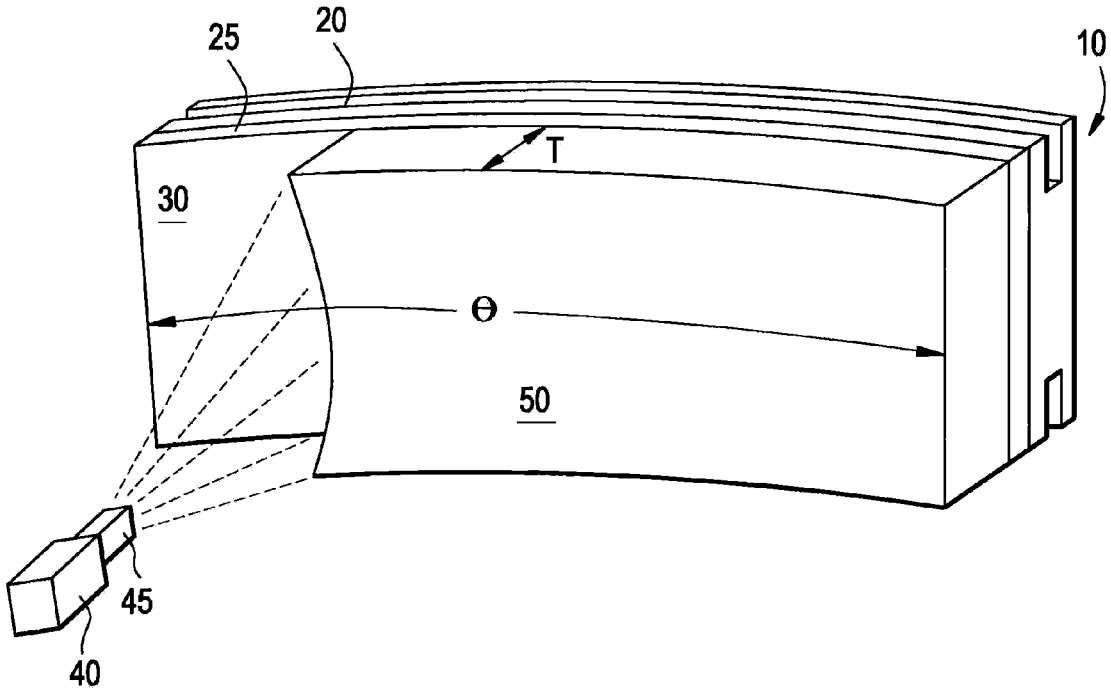
FIG. 1 is a perspective view of an application of a ceramic coating.
Figure 4:
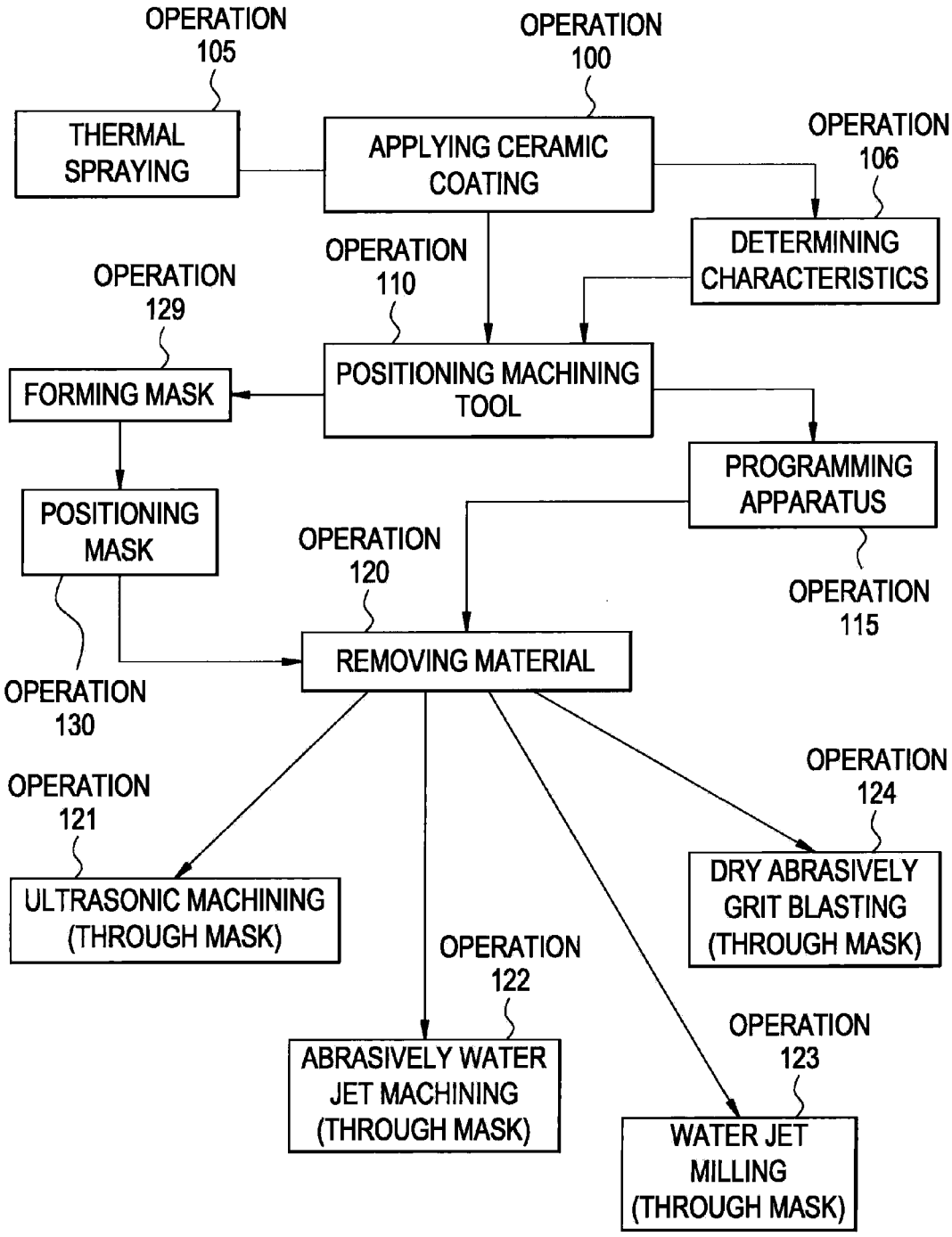
FIG. 4 is a flow diagram of a method of machining a profile pattern in a ceramic coating.

Referring to FIGS. 1 and 4, a system 10 for use in, e.g., a turbine, is provided and includes a turbine shroud 20, or some other similar article, including a metal shroud substrate 25 and a MCrAlY bond coat. The turbine shroud 20 is formed of materials that are able to withstand normal turbine operating conditions and may include a set of tiles, which are provided in a substantially cylindrical arrangement and which are supported by a block or an outer shroud. The surface 30 represents a portion of the turbine shroud 20/metal shroud substrate 25 that faces the interior of the cylinder. The surface 30 is further provided with a ceramic coating 50, such as a thermal barrier coating (TBC), which is capable of, e.g., surviving the high temperature environment of the turbine during operations thereof. With this construction, the turbine shroud 20 is configured to surround, with little or no clearance, a turbine bucket that rotates about a central longitudinal axis of the cylinder during the operations of the turbine.

The system 10 as discussed above has applications beyond those relating to the turbine shroud 20. These include substrates and articles used in various industries having respective surfaces 30 on which the ceramic coating 50 could be applied.

The ceramic coating 50 is applied onto the surface 30 through a nozzle head 45 of the nozzle 40. More specifically, the ceramic coating 50 may be thermal sprayed onto the surface 30 to have a substantially uniform thickness T at an initial time. The substantial uniformity of the thickness T refers to a general uniformity in the thickness of the ceramic coating 50 and also to the lack of readily discernable patterns defined therein by the application of the ceramic coating 50. The thickness T is selected such that an innermost circumference, θ, of the ceramic coating 50 around the cylinder is generally similar to an outermost circumference that would be expected to be traced by an outermost tip of the rotating turbine bucket. Here, it is understood that the ceramic coating 50 may further include 2 or more layers with each having a characteristic porosity. For example, those layers of the ceramic coating 50 near a gas path may have a higher porosity than layers underneath.

During operations of the turbine, the turbine shroud 20 may thermally expand in a non-uniform manner. As a result, the tip of the turbine bucket may cut material away from and thereby abrade some regions of the ceramic coating 50. This process can damage the turbine bucket, the ceramic coating 50 and the shroud 20.

However, risks of such damages or other similar failures that would be caused by the turbine bucket abrading the ceramic coating 50 are substantially mitigated as discussed herein. That is, material of the ceramic coating 50 may be removed therefrom in order to form a profile pattern P therein. The profile pattern P may have various patterns, such as "w" patterns (see FIGS. 2A and 3A) or straight lines, within the ceramic coating 50. Further, the profile pattern P may have rounded peaks and/or valleys, and the frequencies thereof or the slopes of the sides can be varied.

The profile pattern P provides several advantages including, but not limited to, aiding in the abradability of the ceramic coating 50 so as to prevent excessive losses of bucket tip material, to allow for efficient direction of airflow in the turbine during operations thereof, and to allow for a reduction in initial and post-operational turbine bucket tip/shroud clearance.

The profile pattern P increases the abradability of the ceramic coating 50, which, as a result, tends to be less damaging to the bucket tip than a normal shroud coating. Thus, the abradable material of the ceramic coating 50 may be removed by the bucket tip with a minimal loss of bucket tip material. In addition, a ceramic coating 50 in which the profile pattern P is formed will have a lesser volume of abradable material to be removed. As such, excessive loss of bucket tip material may be avoided. Another advantage of the profile pattern P, especially one embodiment thereof that mimics the camber line of the turbine bucket, is that it helps direct the airflow at the shroud surface. Having the airflow better directed at the subsequent nozzle stage thereby improves turbine performance.

As an additional matter, since the profile pattern P is formed in the ceramic coating 50 after the ceramic coating 50 is applied to the surface 30, a need for a shielding mask to be used during the application of the ceramic coating 50 is alleviated. That is, thermal spray through the shielding mask is generally difficult due to the high temperatures achieved during coating deposition, the tendency for coating material to build up on the mask, which can close the openings through which the coating is deposited, the need to clean coating deposited on the mask, or the need for relatively frequently replace the mask. Without the need for the shielding mask, these issues are avoided. Moreover, it may be seen that the ceramic coating 50 can be applied to the surface 30 with more control of its thickness and density. This further facilitates the generation of elaborate and complex detailed profile patterns P.

Figure 2A:
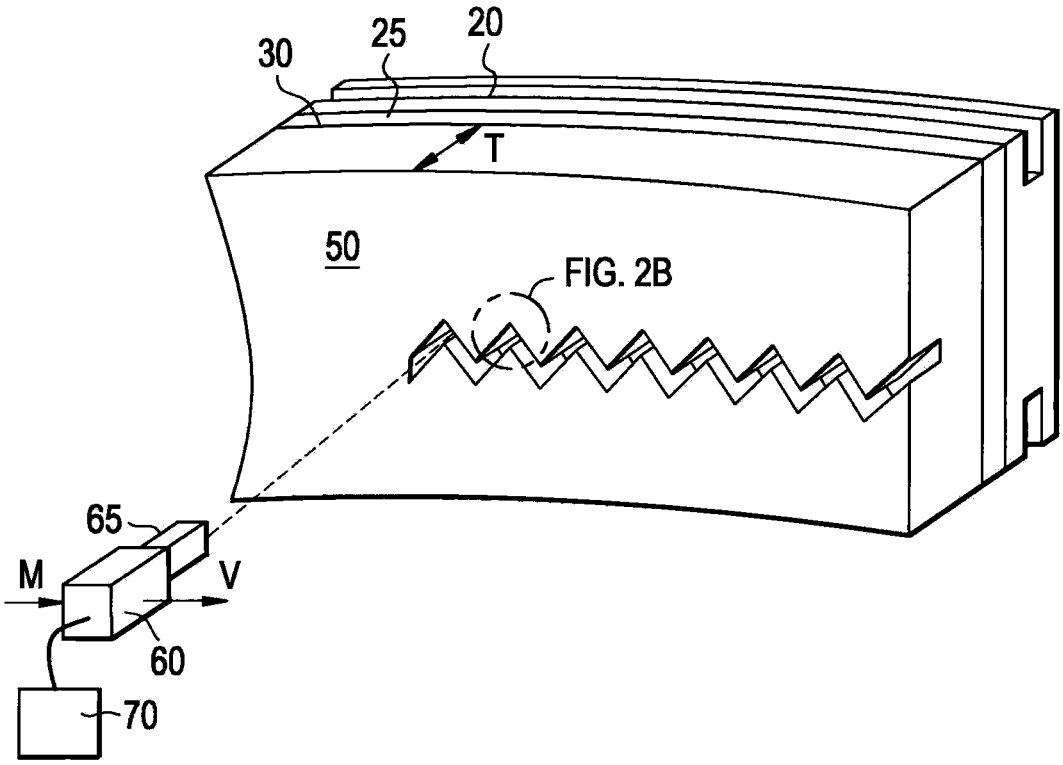
FIG. 2A is a perspective view of a removal of material from the ceramic coating of FIG. 1.
Figure 2B:
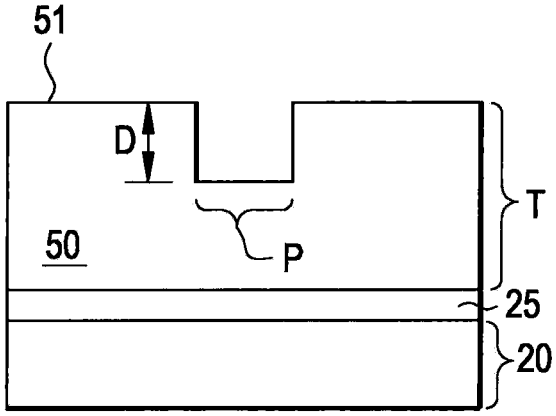
FIG. 2B is a magnified cross-sectional view of a profile pattern formed by the removal operations of FIG. 2A.

With reference to FIGS. 2A and 2B, in which the turbine shroud 20 is shown with the ceramic coating 50 previously applied thereto, a machining tool 60 is positioned and movably supported by a machining tool supporting apparatus 70, such as a controller coupled to a robotic arm that is further coupled to the machining tool 60. Control of the tool motion could also be achieved with any well known controlling system, such as CNC. The machining tool 60 is positioned and movably supported to machine the profile pattern P and, where necessary, cooling holes and other features into the ceramic coating 50.

To this end, the machining tool supporting apparatus 70 may be programmed to move the machining tool 60 in accordance with a movement pattern M that corresponds to the profile pattern P, a design of which is pre-selected. Further, the machining tool supporting apparatus 70 may be programmed to move the machining tool 60 at a speed V that provides for the machining of the ceramic coating 50 to a depth D as measured from a surface 51. The depth D is also pre-selected in accordance with the design of the profile pattern P and would be generally less than the thickness T of the ceramic coating 50.

The machining tool 60 can accomplish the removal of the material of the ceramic coating 50 in accordance with various machining methods that allow for the formation of simple and/or complex patterns, such as curvilinear arcs and/or w-shaped patterns, in the ceramic coating 50.

For example, the machining tool 60 may ultrasonically machine the ceramic coating 50. Here, high frequency electrical energy is utilized to drive a piezoelectric transducer to create mechanical motion of a horn and a cutting tool of a machining head 65 of the machining tool 60. The horn and cutting tool of the machining head 65 vibrate thousands of times per second while abrasive slurry is dispersed between the vibrating cutting tool and the ceramic coating 50. As the abrasive slurry passes between the vibrating cutting tool and the ceramic coating 50, the vibrating cutting tool causes micro-fracturing of the material of the ceramic coating 50.

In another example, the machining tool 60 may abrasively water jet mill the ceramic coating 50. Here, a high pressure jet of water (having, e.g., a pressure of about 50,000 psi) is mixed with fine abrasive particles, such as aluminum oxide particles, and is ejected from the machining head 65 toward the ceramic coating 50 to achieve the ceramic coating 50 material removal. Since abrasive water jet milling exerts only minimal lateral force on the part, this machining method avoids lateral deflection in the ceramic coating 50. Moreover, abrasive water jet milling methods can be cold-operated, so that thermally induced stresses or heat-effected zones of the ceramic coating 50 may be avoided.

In still other examples, the ceramic coating 50 material removal may be accomplished by water jet milling and dry abrasive grit blasting. Water jet milling is similar to abrasive water jet milling except that it does not involve the mixing of the water jet with the fine abrasive particles. Dry abrasive grit blasting is also similar to abrasive water jet milling except that the dry abrasive grit blasting may be conducted at lower overall pressures as compared to water jet milling and that the quantity of water is significantly and/or completely reduced while a concentration of the fine abrasive particles is increased.

In still other examples of possible machining methods for use with non-ceramic, relatively soft or non-abrasive coatings, the material removal may be accomplished with electro-discharge machining (EDM), electro-chemical machining (ECM) or mechanical milling.

With respect to each of these machining methods, each machining method can be used alone or in combination with another. For example, the water jet milling method may be used in combination with the abrasive water jet milling method to achieve a particular profile pattern P.

Figure 3A:
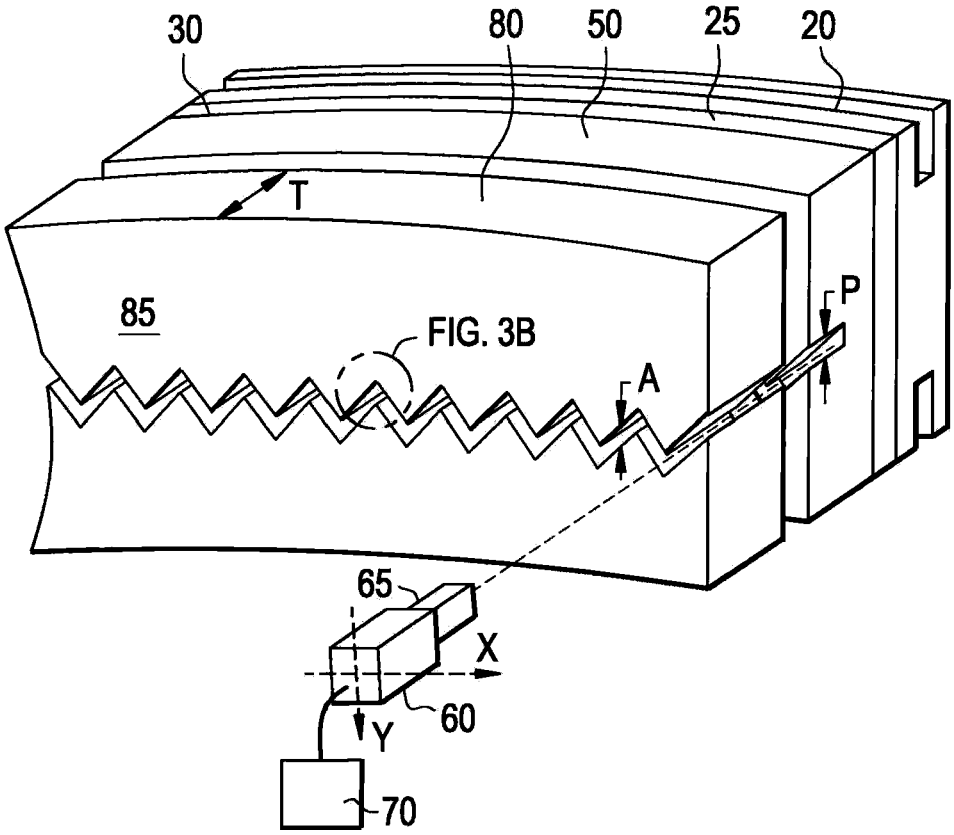
FIG. 3A is a perspective view of a removal of material from the ceramic coating of FIG. 1.
Figure 3B:
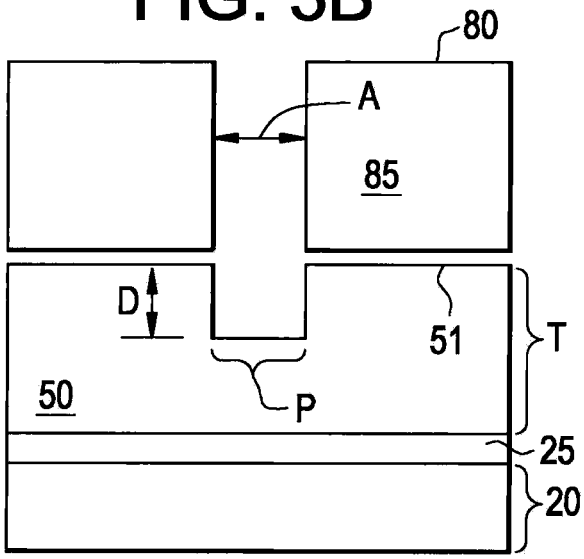
FIG. 3B is a magnified cross-sectional view of a profile pattern formed by the removal operations of FIG. 3A.

With reference to FIGS. 3A and 3B, in which the turbine shroud 20 is shown with the ceramic coating 50 previously applied thereto, a mask 80 or a stencil, which may be made of disposable materials, is provided between the machining tool 60 and the ceramic coating 50. The mask 80 is configured with a form 85 that defines an aperture pattern A, which is reflective of the profile pattern P. With this configuration, when the machining tool 60 is activated, the machining tool 60 machines the ceramic coating 50 through the form 85 of the mask 80, in a manner that is generally similar to those which are described above, to form the profile pattern P in the ceramic coating 50. When a mask is utilized, it would be possible to move the machining tool 60 in a simple X-Y raster pattern rather than following the movement pattern M; this simplifies any programming needs. It is further possible that the machining tool 60 need not be movably supported by the machining tool supporting apparatus 70 when the mask 80 is employed. In fact, as long as the profile pattern P depth D is not required to be strictly controlled, the machining tool 60 could be hand-held when the mask 80 is employed. As an additional matter, the mask 80 will eventually need to be replaced at an end of a lifecycle thereof.

With further reference to FIG. 4, a method of forming a ceramic coating 50 for use with, e.g., a turbine shroud 20 is provided and includes applying the ceramic coating 50 substantially uniformly onto a surface 30 of the turbine shroud 20 (operation 100) by, for example, thermal spraying (operation 105), optionally determining characteristics of a cutting pattern corresponding to a selected profile pattern P (operation 106), positioning a machining tool 60 proximate the ceramic coating 50 (operation 110), and selectively removing material from the ceramic coating 50 as described above (operations 120-124).

With respect to the operation of optionally determining characteristics of the cutting pattern (operation 106), it is noted that this could be accomplished by design analysis. That is, a shape of the turbine bucket, as designed, could be analyzed. A result of this analysis could be employed to determine those characteristics of the profile pattern P which will most efficiently aid in the abradability of the ceramic coating 50 and which will be most likely to efficiently direct airflow in the turbine during operations thereof.

The method may further include programming a machining tool supporting apparatus 70 to move the machining tool 60 along the movement pattern M (operation 115). Alternatively, the method may further include forming a mask 80 that is configured to reflect the determined characteristics of the cutting pattern (operation 129) and positioning the mask 80 between the ceramic coating 50 and the machining tool 60 (operation 130). Here, the selective removing of the material comprises machining the ceramic coating 50 through the mask 80 (operations 120-124).

This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method of machining a profile pattern in a ceramic coating of an article, comprising:

applying the ceramic coating substantially uniformly onto the article;

positioning a machining tool proximate the ceramic coating; and removing material from the ceramic coating by activating the machining tool to machine the ceramic coating and by moving the machining tool across the ceramic coating along a movement pattern that generally corresponds to the profile pattern.

2. The method according to claim 1, wherein the applying of the ceramic coating comprises thermal spraying the ceramic coating onto the article.

3. The method according to claim 1, further comprising programming a machining tool supporting apparatus to move the machining tool along the movement pattern.

4. The method according to claim 1, wherein the removing of the material comprises ultrasonically machining the ceramic coating.

5. The method according to claim 1, wherein the removing of the material comprises abrasively water jet milling the ceramic coating.

6. The method according to claim 1, wherein the removing of the material comprises water jet milling the ceramic coating.

7. The method according to claim 1, wherein the removing of the material comprises dry abrasively grit blasting the ceramic coating.

8. The method according to claim 1, wherein the removing of the material comprises positioning a mask, configured to reflect the profile pattern, between the ceramic coating and the machining tool.

9. The method according to claim 8, further comprising abrasively water jet milling the ceramic coating through the mask.

10. The method according to claim 8, further comprising water jet milling the ceramic coating through the mask.

11. The method according to claim 8, further comprising dry abrasively grit blasting the ceramic coating through the mask.

12. The method according to claim 1, wherein the article comprises a turbine shroud.

13. A method of forming a ceramic coating for a turbine shroud, comprising:

applying the ceramic coating substantially uniformly onto a surface of the turbine shroud configured to face a rotating turbine bucket;

determining characteristics of a cutting pattern that corresponds to a selected profile pattern in the ceramic coating;

positioning a machining tool proximate the ceramic coating; and selectively removing material from the ceramic coating by activating the machining tool to machine the ceramic coating and by moving the machining tool across the ceramic coating along a movement pattern that corresponds to the determined characteristics of the cutting pattern.

14. The method according to claim 13, wherein the determining of the characteristics is accomplished by design analysis of the turbine shroud and the rotating turbine bucket.

15. The method according to claim 13, further comprising programming a machining tool supporting apparatus to move the machining tool along the movement pattern.

16. The method according to claim 13, further comprising:

forming a mask configured to reflect the determined characteristics of the cutting pattern; and positioning the mask between the ceramic coating and the machining tool.

17. The method according to claim 16, wherein the removing of the material comprises machining the ceramic coating through the mask.

18. A system configured to form a profile pattern in a ceramic coating of a surface of a turbine shroud, the system comprising:

a nozzle configured to apply the ceramic coating substantially uniformly onto the surface of the turbine shroud;

a machining tool positioned proximate the ceramic coating and configured to machine the profile pattern in the ceramic coating; and a machining tool supporting apparatus configured to movably support the machining tool along a movement pattern which maintains the machining tool in position proximate the ceramic coating and which corresponds to the profile pattern, the system further comprising a mask, disposed between the ceramic coating and the machining tool, configured with a form that is reflective of the profile pattern and through which the machining tool machines the ceramic coating.

* * * * *